US011612541B1

(12) United States Patent
Shi

(10) Patent No.: US 11,612,541 B1
(45) Date of Patent: Mar. 28, 2023

(54) SPA BATHTUB AND OPERATING UNIT FOR THE SPA BATHTUB

(71) Applicant: DONGGUAN HONGYU PLASTIC CO., LTD, Dongguan (CN)

(72) Inventor: Juying Shi, Dongguan (CN)

(73) Assignee: DONGGUAN HONGYU PLASTICS CO., LTD

( * ) Notice: Subject to any disclaimer, the term of this patent is extended or adjusted under 35 U.S.C. 154(b) by 0 days.

(21) Appl. No.: 17/744,304

(22) Filed: May 13, 2022

Related U.S. Application Data

(63) Continuation-in-part of application No. 17/714,604, filed on Apr. 6, 2022.

(51) Int. Cl.
*A61H 33/00* (2006.01)

(52) U.S. Cl.
CPC ..... *A61H 33/0087* (2013.01); *A61H 33/005* (2013.01); *A61H 33/0095* (2013.01); *A61H 33/601* (2013.01)

(58) Field of Classification Search
CPC ..... A61H 33/02; A61H 33/025–028; A61H 33/14; A61H 33/6026; E03D 1/32–34; E03D 5/022–024; E03D 5/10–105; E04H 4/169; F16K 11/22; F16K 31/04–055; F16K 31/06–088
See application file for complete search history.

(56) References Cited

U.S. PATENT DOCUMENTS 4,857,112 A 8/1989 Fränninge
4,874,012 A 10/1989 Velie
5,095,559 A * 3/1992 Liljegren ..... A61H 33/025 219/217

(Continued)

FOREIGN PATENT DOCUMENTS

CN 112569105 * 3/2021 ..... A61H 33/12
DE 19606370 A1 8/1997

(Continued)

OTHER PUBLICATIONS

Non-Final Office Action for U.S. Appl. No. 17/714,604, dated Jul. 8, 2022, 17 Pages.

*Primary Examiner* — David P Angwin
*Assistant Examiner* — Nicholas A Ros
(74) *Attorney, Agent, or Firm* — Dickinson Wright PLLC

(57) ABSTRACT

An SPA bathtub and an operating unit therefor are provided. The operating unit includes a gas supply system including an electric gas valve, at least one gas path connecting pipe and an electric gas pump that can be in fluid communication with the SPA bathtub through them. The electric gas valve includes a valve housing defining at least one inner cavity. The valve housing is provided with a gas inlet configured to communicate with the electric gas pump, and at least one gas outlet each provided therein with a moving piston and configured to communicate with corresponding gas path connecting pipe. Each inner cavity is in fluid communication with corresponding gas path connecting pipe via one gas outlet. The electric gas pump cooperates with the electric gas valve such that: when the electric gas pump operates/stops operating, the moving piston is located in a communication position/an off position.

19 Claims, 8 Drawing Sheets

(56) References Cited

U.S. PATENT DOCUMENTS

| | | | | |
|---|---|---|---|---|
| 5,548,854 | A * | 8/1996 | Bloemer | A61H 33/60 4/541.6 |
| 6,412,123 | B1 | 7/2002 | Lau | |
| 7,461,416 | B2 | 12/2008 | Stover | |
| 8,095,998 | B2 | 1/2012 | Lau | |
| 9,173,808 | B2 * | 11/2015 | Ciechanowski | A61H 33/60 |
| 9,254,240 | B2 * | 2/2016 | Lin | A61H 33/6005 |
| 11,111,923 | B2 | 9/2021 | Dorsey | |
| 2015/0184870 | A1 | 7/2015 | Bernardo et al. | |
| 2015/0377497 | A1 | 12/2015 | Haws | |
| 2021/0077346 | A1 * | 3/2021 | Luong | A47C 1/04 |

FOREIGN PATENT DOCUMENTS

| | | | |
|---|---|---|---|
| DE | 202008010345 | U1 | 10/2008 |
| EP | 3800387 | A1 | 4/2021 |

* cited by examiner

SPA BATHTUB AND OPERATING UNIT FOR THE SPA BATHTUB

CROSS-REFERENCE TO RELATED APPLICATION

The application is a continuation-in-part of U.S. application Ser. No. 17/714,604 filed with the USPTO on Apr. 6, 2022, all the contents of which is incorporated herein by reference in its entirety.

TECHNICAL FIELD

The present disclosure relates to the technical field of SPA bathtubs, and in particular to an operating unit for an SPA bathtub and an SPA bathtub.

BACKGROUND ART

This section provides background information related to the present disclosure, but the information does not necessarily constitute the prior art.

Compared with conventional bathtubs, SPA (Solus Par Agula) bathtubs have massage and leisure functions, and users can relax oneself and enjoy life while using the SPA bathtubs to take a bath, so the SPA bathtubs are more and more popular. Inside the SPA bathtubs, a gas supply system may be provided to provide a gas to an interior volume portion of the bathtub or to a bathtub wall of an inflatable bathtub to realize a surfing function of the SPA bathtub and an inflation function of the inflatable bathtub. In addition, a water circulation system for circulating water in the bathtub to assist in achieving functions such as heating and filtering is also provided.

In the current SPA bathtubs, the electric gas pumps are always connected to the bathtub and in communication with water body in the bathtub, therefore, a valve must be connected between the water body in the bathtub and the electric gas pump so as to avoid the water body in the bathtub entering the electric gas pump. In the relevant technical field, a mechanical reflux valve or an electromagnetic valve is usually installed to function as a switch. The disadvantage of the mechanical reflux valve is that the work is relatively damaged, thus increasing the resistance of the electric gas pump. The electromagnetic valve has the disadvantages of a small discharge amount and an expensive price.

For the water circulation system of the SPA bathtubs, the following three types of water pumps are mainly adopted conventionally for water circulation: diaphragm self-priming pump, peristaltic pump, and submersible pump. The diaphragm self-priming pump has a self-priming capability, while the flow rate of the diaphragm self-priming pump is small. An installation position of the peristaltic pump in normal operation needs to be lower than a water level in the bathtub, otherwise, the peristaltic pump needs to be evacuated by filling and guiding water before normal operation. An installation position of the submersible pump in normal operation must be lower than the water level in the bathtub. Due to the limitation of usage environments of the SPA bathtub, it is often inconvenient to fix a water pump, an electric gas pump or the like in a position lower than the water level in the bathtub, resulting in use restriction to the SPA bathtub.

Therefore, it is necessary to provide an improved gas supply system and an improved water circulation system for the SPA bathtubs, so that on one hand, the operation of the SPA bathtubs can be conveniently carried out, and on the other hand, they are not restricted by the use environments of the SPA bathtubs, thereby at least solving one or all of the above problems.

SUMMARY

This section provides general summary of the present disclosure, rather than comprehensive disclosure of a full scope or all features of the present disclosure.

In one aspect, the present disclosure provides an operating unit for an SPA bathtub, the operating unit is detachably attached to the SPA bathtub, and the operating unit includes a gas supply system configured to supply a gas to the SPA bathtub, wherein the gas supply system includes an electric gas pump, an electric gas valve, and at least one gas path connecting pipe, the electric gas pump is configured to be able to be in fluid communication with the SPA bathtub through the electric gas valve and the at least one gas path connecting pipe, and the electric gas valve includes a valve housing defining at least one inner cavity, wherein the valve housing is provided with: a gas inlet configured to be in communication with the electric gas pump, and at least one gas outlet each configured to be in communication with corresponding one of the at least one gas path connecting pipe, the at least one inner cavity is each in fluid communication with a corresponding gas path connecting pipe via a corresponding gas outlet, each inner cavity is provided therein with a moving piston, and the electric gas pump and the electric gas valve are configured to cooperate with each other in such a manner that: during operation of the electric gas pump, the moving piston in the electric gas valve is located in a communication position such that the corresponding gas outlet is opened to allow fluid communication between the electric gas pump and the gas path connecting pipe, and when the electric gas pump stops operating, the moving piston in the electric gas valve is located in an off position where the corresponding gas outlet is closed to block the fluid communication between the electric gas pump and the gas path connecting pipe.

For the gas supply system of the operating unit for an SPA bathtub according to an exemplary embodiment of the present disclosure, through the design of the moving piston in the electric gas valve in the operating unit for an SPA bathtub, it is realized that large flow of gas can be supplied when using the electric gas pump to supply the gas, and meanwhile the resistance to the electric gas pump is also reduced, thereby improving efficiency of supplying gas to the bathtub.

Optionally, in some embodiments of the present disclosure, the electric gas valve further includes an electric motor positioned on the valve housing for driving the moving piston, the electric motor is configured to be rotatable in a first direction and a second direction opposite to each other and includes a driving gear on an output shaft of the electric motor, wherein the moving piston is configured to be coupled to a rack configured to be meshed with the driving gear of the electric motor, such that through the meshing between the driving gear and the rack, the moving piston can move towards the communication position when the electric motor is rotated in the first direction, and move towards the off position when the electric motor is rotated in the second direction.

Optionally, in some embodiments of the present disclosure, the operating unit further includes a plurality of sensors and a control panel in communication with the plurality of sensors, the plurality of sensors are configured to measure an operation state of the SPA bathtub and send to the control panel a signal indicating an operation state of the SPA bathtub, the control panel is configured to receive an external input instruction of controlling the operation of the SPA bathtub and the signal indicating the operation state of the SPA bathtub from the plurality of sensors, and generate a physical operation command according to the external input instruction and the signal for the SPA bathtub.

Optionally, in some embodiments of the present disclosure, the electric gas pump and the electric gas valve are respectively in communication with the control panel and cooperate with each other in such a manner that: when the electric gas pump receives the operation command of stopping operating from the control panel, the moving piston in the electric gas valve moves towards an off position where the corresponding gas outlet is closed to block the fluid communication between the electric gas pump and the gas path connecting pipe, and the electric gas pump stops operating when the moving piston in the electric gas valve reaches the off position.

Optionally, in some embodiments of the present disclosure, a stop portion is provided in each inner cavity of the valve housing, and the stop portion is configured such that the moving piston completely closes the gas outlet when abutting against the stop portion, the electric motor is in communication with the control panel, and the electric motor cooperates with the electric gas pump in such a manner that when the electric gas pump receives the operation command of stopping operating, the moving piston is enabled by the electric motor to move back to a state of abutting against the stop portion.

Optionally, in some embodiments of the present disclosure, the at least one gas path connecting pipe is configured to be capable of being in fluid communication with an interior volume portion of the SPA bathtub.

Optionally, in some embodiments of the present disclosure, the SPA bathtub includes an inflatable bathtub wall and the interior volume portion enclosed by the inflatable bathtub wall, the operating unit includes two gas path connecting pipes respectively in communication with two inner cavities of the electric gas valve, a first gas path connecting pipe in the two gas path connecting pipes is configured to be capable of being connected with an inflation valve of the inflatable bathtub wall, so that the gas from the electric gas pump can be charged into the interior of the inflatable bathtub wall via the inflation valve to inflate the inflatable bathtub wall, and a second gas path connecting pipe in the two gas path connecting pipes is configured to be capable of being in fluid communication with the interior volume portion of the SPA bathtub, so that the gas from the electric gas pump can be supplied into the interior volume portion of the inflatable SPA bathtub.

Optionally, in some embodiments of the present disclosure, the SPA bathtub includes an inflatable bathtub wall, the operating unit includes at least one gas path connecting pipe in communication with an inner cavity of the electric gas valve, each gas path connecting pipe is configured to be capable of being connected to the inflation valve of the inflatable bathtub wall, so that the gas from the electric gas pump can be charged into the interior of the inflatable bathtub wall via the inflation valve so as to inflate the inflatable bathtub wall.

Optionally, in some embodiments of the present disclosure, the operating unit includes at least one gas path connecting pipe in communication with the inner cavity of the electric gas valve, and each gas path connecting pipe is configured to be capable of being in fluid communication with the interior volume portion of the SPA bathtub, so that the gas from the electric gas pump can be charged into the interior volume portion of the SPA bathtub.

Optionally, in some embodiments of the present disclosure, the operating unit includes a first electric motor configured to drive a first moving piston provided in a first inner cavity in communication with the first gas path connecting pipe, and a second electric motor configured to drive the second moving piston provided in the second inner cavity in communication with the second gas path connecting pipe, wherein the first electric motor and the second electric motor can be independently operated, and the first electric motor and the second electric motor are configured to cooperate with each other in such a manner that: when the first electric motor is rotated in the first direction to drive the first moving piston to move towards the communication position, the second electric motor is not operated, or the second electric motor is rotated in the second direction to drive the second moving piston to move towards the off position; and when the second electric motor is rotated in the first direction to drive the second moving piston to move towards the communication position, the first electric motor is not operated, or the first electric motor is rotated in the second direction to drive the first moving piston to move towards the off position.

Optionally, in some embodiments of the present disclosure, the operating unit further includes a gas pressure monitoring device configured to detect gas pressure inside the inflatable bathtub wall, and the gas pressure monitoring device sends, when detecting that the gas pressure inside the inflatable bathtub wall reaches or is greater than a predetermined gas pressure value, a signal to the control panel, so as to generate a physical operation command used to make the first electric motor rotate in the second direction so as to drive the first moving piston to move towards the off position.

Optionally, in some embodiments of the present disclosure, the operating unit further includes a fluid circulation system for performing circulation outside the SPA bathtub (i.e., out-of-bathtub circulation) on a fluid in the SPA bathtub, wherein the fluid circulation system includes a diaphragm self-priming pump, a peristaltic pump, a fluid circulation pipeline, and a fluid switch assembly connecting the diaphragm self-priming pump and the peristaltic pump with the fluid circulation pipeline, the peristaltic pump is provided in such a manner that an inlet of the peristaltic pump can be in fluid communication with an interior volume portion of the SPA bathtub and an outlet of the peristaltic pump is in fluid communication with an inlet of the fluid switch assembly, the diaphragm self-priming pump is provided in such a manner that an inlet of the diaphragm self-priming pump is in fluid communication with the outlet of the peristaltic pump and an outlet of the diaphragm self-priming pump can be in fluid communication with an outlet of the fluid switch assembly, the fluid circulation pipeline is provided in such a manner that an inlet of the fluid circulation pipeline is in fluid communication with the outlet of the fluid switch assembly and the outlet of the fluid circulation pipeline is in fluid communication with the interior volume portion of the SPA bathtub, the diaphragm self-priming pump, the peristaltic pump, and the fluid switch assembly are configured to cooperate with each other in such a manner that: the diaphragm self-priming pump operates before the peristaltic pump operates normally and stops operating after the peristaltic pump operates normally, and the fluid switch assembly has a first operation state and a second operation state, wherein during the operation of the diaphragm self-priming pump, the fluid switch assembly is in the first operation state, so that the fluid from the interior volume portion of the SPA bathtub flows through the peristaltic pump, the diaphragm self-priming pump, the fluid switch assembly, and the fluid circulation pipeline in sequence and finally returns back to the interior volume portion of the SPA bathtub, and during the operation of the peristaltic pump, the fluid switch assembly is in the second operation state, so that the fluid from the interior volume portion of the SPA bathtub flows through the peristaltic pump, the fluid switch assembly, and the fluid circulation pipeline in sequence and finally returns back to the interior volume portion of the SPA bathtub.

For the water circulation system of the operating unit for an SPA bathtub according to an exemplary embodiment of the present disclosure, through the cooperation between the diaphragm self-priming pump, the peristaltic pump, and the fluid switch assembly, the installation and the use of the water circulation system of the bathtub are no longer restricted by the water level in the bathtub, and the water circulation of the water in the SPA bathtub still can be realized even in the case of a low water level, thus assisting in realizing the function of heating or filtering the water in the SPA bathtub, so that the problem of having to be installed at a low water level is resolved in the related technical field. The operating unit for an SPA bathtub according to the exemplary embodiment of the present disclosure is easier to install and use, and has wider application scenarios.

Optionally, in some embodiments of the present disclosure, the fluid switch assembly includes a housing member, wherein a first cavity and a second cavity are provided in the housing member along a longitudinal direction of the housing member, the first cavity and the second cavity are in fluid communication with each other via a first opening, the outlet of the peristaltic pump and the inlet of the diaphragm self-priming pump are both in fluid communication with the first cavity, the outlet of the diaphragm self-priming pump and the inlet of the fluid circulation pipeline are both in fluid communication with the second cavity, the fluid switch assembly further includes a fluid switch piston, the fluid switch piston is received in the second cavity and can move in the second cavity, wherein during operation of the diaphragm self-priming pump, the fluid switch piston is located in a first operating position so as to close the first opening, and during operation of the peristaltic pump, the fluid switch piston moves from the first operating position to a second operating position where fluid communication between the first cavity and the second cavity is allowed.

Optionally, in some embodiments of the present disclosure, the fluid switch assembly further includes at least one first magnet positioned in the second cavity and at least one second magnet positioned on the fluid switch piston and opposite to the first magnet, the first magnet and the second magnet are provided in such a manner that ends having the same polarity are opposite to each other, an interaction force between the first magnet and the second magnet is set to be suitable for maintaining the fluid switch piston in the first operating position and less than an operating fluid pressure of the peristaltic pump.

Optionally, in some embodiments of the present disclosure, the fluid switch assembly further includes a biasing device mounted in the second cavity, the biasing device abuts against the fluid switch piston and applies a biasing force to the fluid switch piston towards the first operating position, and a sum of the biasing force and the interaction force between the first magnet and the second magnet is less than the operating fluid pressure of the peristaltic pump.

Optionally, in some embodiments of the present disclosure, the operating unit further includes a heater configured to heat the fluid circulation pipeline, particularly, the heater is a PTC heater, the heater is in communication with the control panel, the plurality of sensors include an inductor provided at an outside of the housing member, the inductor is positioned close to an end of the first magnet facing the second magnet and is configured to: send a first output signal to the control panel when a distance between the second magnet and the first magnet is less than or equal to a preset spacing value, so as to generate an operation command used to make the heater start operating, and send a second output signal to the control panel when the distance between the second magnet and the first magnet is greater than the preset spacing value, so as to generate an operation command used to make the heater stop operating.

For the water circulation system of an operating unit for an SPA bathtub according to an exemplary embodiment of the present disclosure, through the design of at least one first magnet and at least one second magnet in the fluid switch assembly, when the water flow and the water pressure are insufficient, the fluid switch piston leaves the first magnet due to the interaction force between the first magnet and the second magnet and leaves the inductor, and the inductor notifies the control panel to send a signal used for stopping heating, when the distance between the second magnet and the first magnet is greater than the preset spacing value, thus preventing dry burning and overheating of the heater, so that the use of the bathtub is more safe and more reliable.

Optionally, in some embodiments of the present disclosure, the plurality of sensors further include at least one temperature sensor and/or a leakage inductor provided on the housing member of the fluid switch assembly, the leakage inductor is configured to send a signal to the control panel when sensing that a current having a value greater than a preset current value is present in the fluid flowing through the fluid switch assembly, to generate an operation command used to make the operating unit powered off, and the at least one temperature sensor is configured to send a signal to the control panel when a temperature of the fluid flowing through the fluid switch assembly is higher than a preset temperature value, to generate an operation command used to make the heater stop operating.

Optionally, in some embodiments of the present disclosure, the operating unit can be provided outside the SPA bathtub in a threaded connection manner, or through a hooking device; and alternatively, the operating unit can be provided inside a bathtub wall of the SPA bathtub in an embedded manner.

The operating unit for an SPA bathtub according to an exemplary embodiment of the present disclosure may have a fixed style, can be used with more kinds of bathtubs, can be provided outside the SPA bathtub in a threaded connection manner, or through a hooking device; and alternatively, the operating unit can be provided inside a bathtub wall of the SPA bathtub in an embedded manner, then it has richer usage scenarios, and wider application scenes, and meanwhile reduces the cost of repeated molding.

In another aspect, the present disclosure provides an SPA bathtub, wherein the SPA bathtub includes the operating unit according to the embodiments of the present disclosure.

The SPA bathtub according to the embodiments of the present disclosure at least can realize the following technical effects: through the design of the moving piston in the electric gas valve in the operating unit for an SPA bathtub, it is realized that large flow of gas can be supplied when using the electric gas pump to supply the gas, and meanwhile the resistance to the electric gas pump is also reduced, thereby improving efficiency of supplying gas to the bathtub; besides, by adopting the operating unit according to the embodiments of the present disclosure, the use of the bathtub is no longer restricted by the water level in the bathtub, so that water circulation of the water in the SPA bathtub still can be realized even in the case of a low water level, thereby assisting in realizing the function of heating or filtering of the water in the SPA bathtub, so that the problem of having to be installed at a low water level is resolved in the related technical field; the installation of the operating unit for an SPA bathtub according to an exemplary embodiment of the present disclosure no longer needs a fixed height, enabling easier installation and use. The operating unit for an SPA bathtub according to an exemplary embodiment of the present disclosure may have a fixed style, and can be used with more kinds of bathtubs, then it has richer usage scenarios, and wider application scenes, and meanwhile reduces the cost of repeated molding.

BRIEF DESCRIPTION OF DRAWINGS

Through the following description with reference to the accompanying drawings, the features and advantages of the embodiments of the present disclosure will become easier to understand, the accompanying drawings are not drawn to scale, some features are zoomed in or out to show details of specific parts, and in the drawings.

DETAILED DESCRIPTION OF EMBODIMENTS

Figure 1:
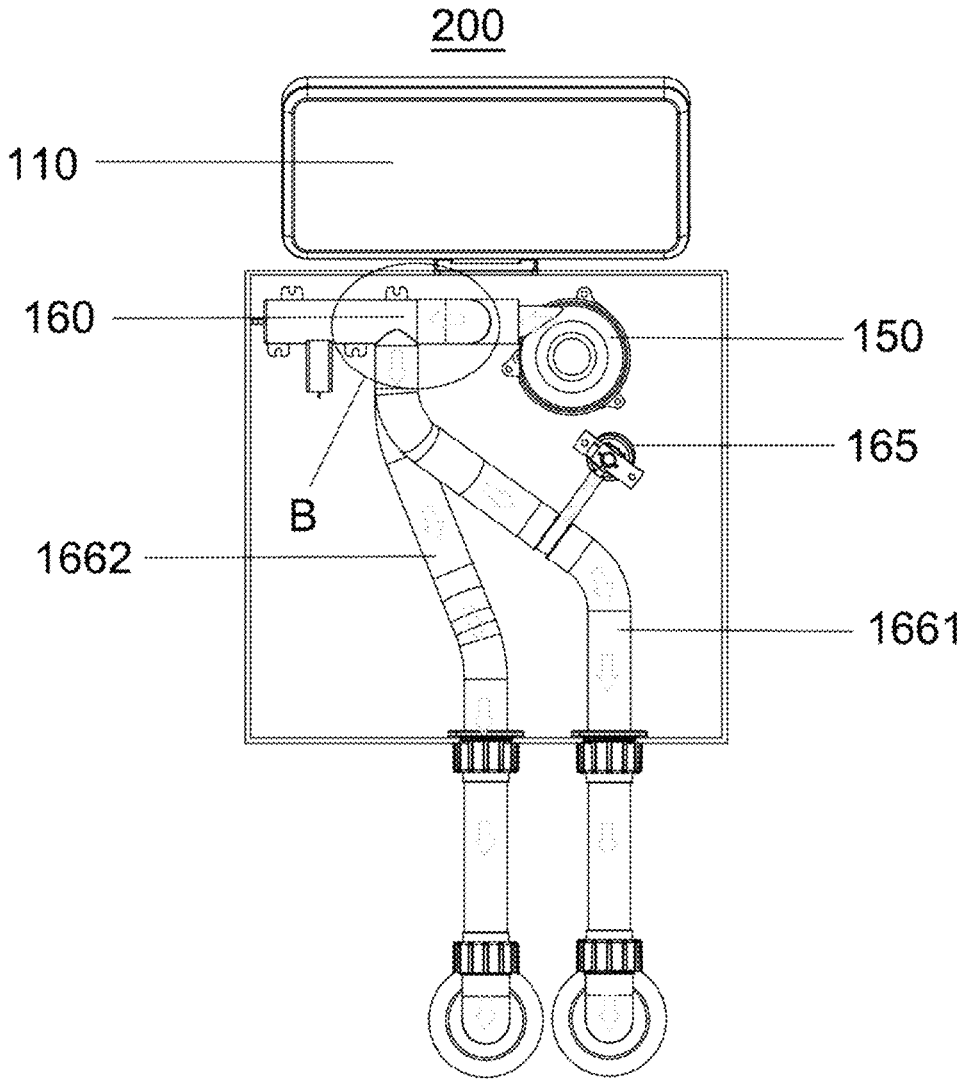
FIG. 1 shows a schematic view of an operating unit for an SPA bathtub according to an exemplary embodiment of the present disclosure.

The present disclosure will be described in detail by means of exemplary embodiments of the present disclosure with reference to the accompanying drawings. It should be noted that the following detailed description of the present disclosure is merely for illustrative purpose, but is in no way limitation to the present disclosure. Besides, the same reference signs are used to denote the same components in various accompanying drawings.

It should also be pointed out that, for the sake of clarity, not all of the features of actual specific embodiments are described and shown in the description and accompanying drawings, and furthermore, in order to avoid obscuring the technical solutions focused in the present disclosure with unnecessary details, in the description and the accompanying drawings, only arrangements and structures closely related to the technical contents of the present disclosure are described and shown, while other details that are not relevant to the technical contents of the present disclosure and are known to those skilled in the art are omitted.

In order to make objectives, technical solutions, and advantages of the embodiments of the present disclosure clearer, various embodiments of the present disclosure will be described in detail below in conjunction with accompanying drawings. However, those of ordinary skill in the art could understand that in various embodiments of the present disclosure, many technical details are provided for the readers to better understand the present disclosure. However, even without these technical details and various changes and modifications based on respective following embodiments, the technical solutions claimed in the present disclosure can also be realized. The division of various following embodiments are for the convenience of description, and should not constitute any limitation on the specific implementation manner of the present disclosure, and various embodiments may be combined with each other and refer to each other without contradiction.

It should be indicated that terms "first", "second" and so on in the description, the claims, and the above accompanying drawings of the present disclosure are used for distinguishing similar objects, are not necessarily used to describe a specific order or sequence, and should not be construed as indicating or implying importance in the relativity or suggesting the number of indicated technical features. Thus, a feature defined with "first" or "second" may explicitly or implicitly mean including one or more such features. It should be understood that the terms used in this way can be exchangeable under appropriate circumstances, so that the embodiments of the present disclosure described herein can be implemented in an order other than those illustrated or described herein. Besides, terms "include (comprise)", "have", and any derivatives thereof are intended to be non-exclusive, for example, a process, a method, a system, a product or a device that contains a series of steps or units is not necessarily limited to those steps or units expressly listed, but may include other steps or units not expressly listed or inherent to such process, method, product or device.

Next, an exemplary embodiment of an operating unit for an SPA bathtub according to the present disclosure will be described in detail with reference to the accompanying drawings.

Figure 2:
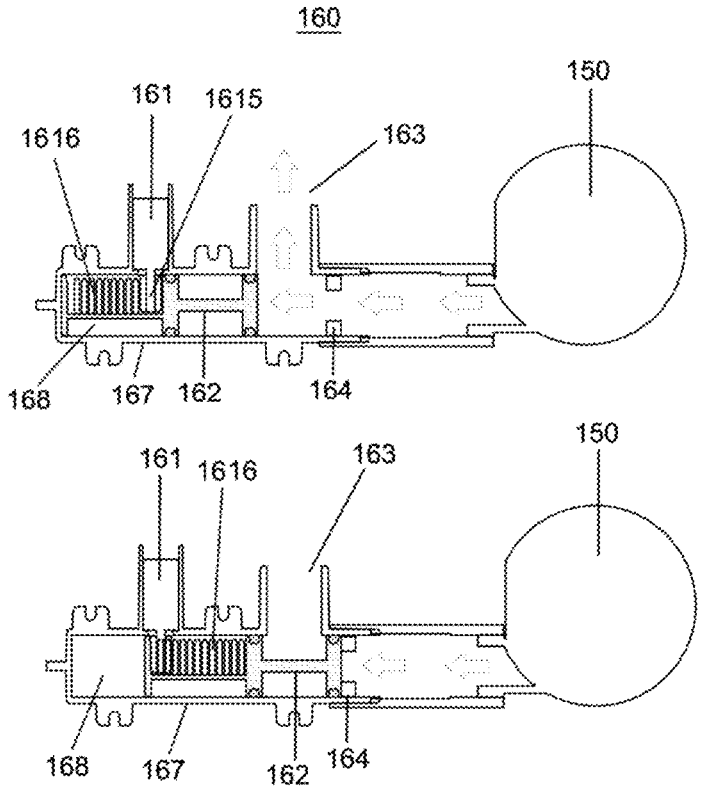
FIG. 2 shows sectional views of an electric gas valve of a gas supply system of an operating unit for an SPA bathtub according to an exemplary embodiment of the present disclosure, in two different operating positions.

FIG. 1 is a schematic view showing the operating unit for an SPA bathtub according to an exemplary embodiment of the present disclosure. FIG. 2 shows sectional views of an electric gas valve of a gas supply system of an operating unit for an SPA bathtub according to an exemplary embodiment of the present disclosure, in two different operating positions. FIG. 2 is a partially enlarged view of portion B of FIG. 1 for the electric gas valve.

An operating unit 200 for an SPA bathtub according to an exemplary embodiment of the present disclosure can be detachably attached to an SPA bathtub, and the operating unit 200 may include a gas supply system for supplying a gas to the SPA bathtub. The gas supply system may include an electric gas pump 150, an electric gas valve 160, and at least one gas path connecting pipe 166. The electric gas pump 150 may be configured to be able to be in fluid communication with the SPA bathtub through the electric gas valve 160 and at least one gas path connecting pipe 166 (e.g., 1661, 1662), and the electric gas valve 160 may include a valve housing 167 defining at least one inner cavity 168. In the above, The valve housing 167 may be provided with: a gas inlet configured to be in communication with the electric gas pump 150, and at least one gas outlet 163 each configured to be in communication with corresponding one of the at least one gas path connecting pipe 166. The at least one inner cavity 168 is each in fluid communication with a corresponding gas path connecting pipe 166 via one gas outlet 163, and each inner cavity 168 is provided therein with a moving piston 162. The electric gas pump 150 and the electric gas valve 160 are configured to cooperate with each other in such a manner that: during operation of the electric gas pump 150, the moving piston 162 in the electric gas valve 160 is located in a communication position such that the corresponding gas outlet is opened to allow the fluid communication between the electric gas pump 150 and the gas path connecting pipe, and when the electric gas pump 150 stops operating, the moving piston 162 in the electric gas valve 160 is located in an off position where the corresponding gas outlet is closed to block the fluid communication between the electric gas pump 150 and the gas path connecting pipe.

For the gas supply system of the operating unit for an SPA bathtub according to an exemplary embodiment of the present disclosure, through the design of the moving piston in the electric gas valve in the operating unit for an SPA bathtub, it is realized that large flow of gas can be supplied when using the electric gas pump to supply gas, and meanwhile the resistance to the electric gas pump is also reduced, thereby improving efficiency of supplying gas to the bathtub.

In some embodiments of the present disclosure, the electric gas valve 160 further may include an electric motor 161 positioned on the valve housing 167 for driving the moving piston 162. The electric motor 161 may be configured to be rotatable in a first direction and a second direction opposite to each other and include a driving gear 1615 on an output shaft of the electric motor 161. The moving piston 162 is configured to be coupled to a rack 1616 configured to be meshed with the driving gear 1615 of the electric motor 161, such that through the meshing between the driving gear 1615 and the rack 1616, the moving piston 162 can move towards the communication position when the electric motor 161 is rotated in the first direction, and move towards the off position when the electric motor 161 is rotated in the second direction.

In some embodiments of the present disclosure, the operating unit 100 further may include a plurality of sensors and a control panel 110 in communication with the plurality of sensors. The plurality of sensors may be configured to measure an operation state of the SPA bathtub and send to the control panel 110 a signal indicating the operation state of the SPA bathtub. The control panel 110 may be configured to receive an external input instruction of controlling the operation of the SPA bathtub and the signal indicating the operation state of the SPA bathtub from the plurality of sensors, and generate for the SPA bathtub a physical operation command according to the external input instruction and the signal.

In some embodiments of the present disclosure, the electric gas pump 150 and the electric gas valve 160 may be in communication with the control panel 110 so as to cooperate with each other in such a manner that: when the electric gas pump 150 receives the operation command of stopping operating from the control panel 110, the moving piston 162 in the electric gas valve 160 moves towards an off position where the corresponding gas outlet is closed to block the fluid communication between the electric gas pump 150 and the gas path connecting pipe, and the electric gas pump 150 stops operating when the moving piston 162 in the electric gas valve 160 reaches the off position.

In some embodiments of the present disclosure, a stop portion 164 may be provided in each inner cavity 168 of the valve housing 167. The stop portion 164 may be configured such that the moving piston 162 completely closes the gas outlet 163 when abutting against the stop portion 164. The electric motor 161 is in communication with the control panel 110, and the electric motor 161 cooperates with the electric gas pump 150 in such a manner that when the electric gas pump 150 receives the operation command of stopping operating, the moving piston 162 is enabled by the electric motor 161 to move back to a state of abutting against the stop portion 164.

In some embodiments of the present disclosure, at least one gas path connecting pipe 166 may be configured to be capable of being in fluid communication with the interior volume portion of the SPA bathtub.

Figure 9:
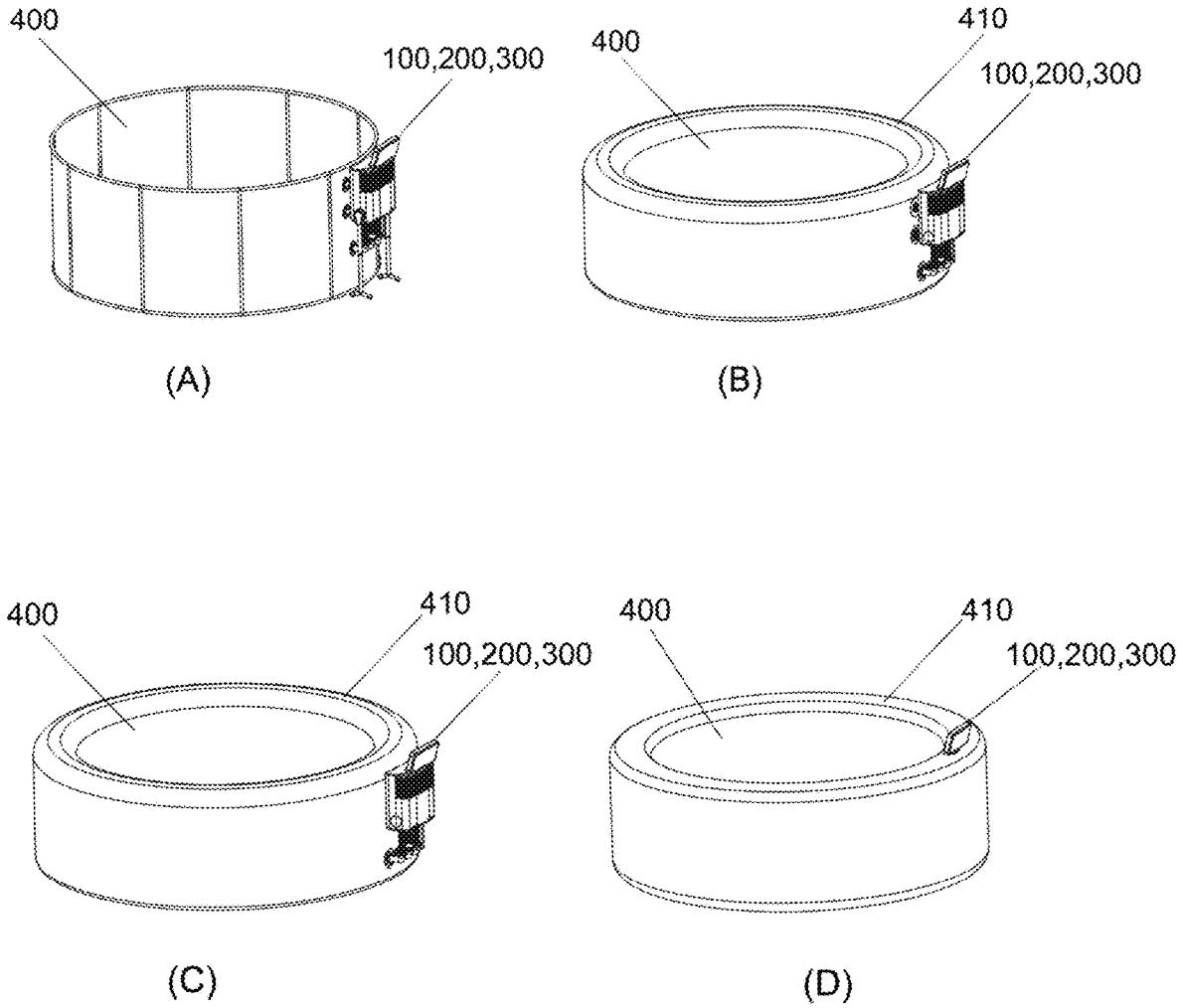
FIG. 9 shows SPA bathtubs according to exemplary embodiments of the present disclosure.

In some embodiments of the present disclosure, the SPA bathtub may include an inflatable bathtub wall 410 (as shown in FIG. 9) and an interior volume portion enclosed by the inflatable bathtub wall 410, and the operating unit 200 may include two gas path connecting pipes 166 respectively in communication with two inner cavities 168 of the electric gas valve 160. A first gas path connecting pipe 1661 in the two gas path connecting pipes 166 may be configured to be capable of being connected with an inflation valve of the inflatable bathtub wall 410, so that the gas from the electric gas pump 150 can be charged into the interior of the bathtub wall of the inflatable bathtub wall via the inflation valve to inflate the inflatable bathtub wall 410. A second gas path connecting pipe 1662 in the two gas path connecting pipes 166 may be configured to be capable of being in fluid communication with the interior volume portion of the SPA bathtub, so that the gas from the electric gas pump 150 can be supplied into the interior volume portion of the inflatable SPA bathtub. It can be understood that in this embodiment of the present disclosure, the gas supply system may include two gas path connecting pipes, and the two gas path connecting pipes are respectively configured to inflate and surf the SPA bathtub, but the number of gas path connecting pipes is not limited in the present disclosure, that is to say, the number of gas path connecting pipes may be one or more, as long as the purpose of supplying gas to the bathtub can be satisfied. A person skilled in the art could select the specific number of gas path connecting pipes according to actual requirements.

In some embodiments of the present disclosure, the SPA bathtub may include an inflatable bathtub wall 410, the operating unit 200 may include at least one gas path connecting pipe in communication with an inner cavity of the electric gas valve, each gas path connecting pipe is configured to be capable of being connected to the inflation valve of the inflatable bathtub wall 410, so that the gas from the electric gas pump can be charged into the interior of the inflatable bathtub wall 410 via the inflation valve.

In some embodiments of the present disclosure, the operating unit 200 may include at least one gas path connecting pipe in communication with the inner cavity of the electric gas valve 160, each gas path connecting pipe is configured to be capable of being in fluid communication with the interior volume portion of the SPA bathtub, so that the gas from the electric gas pump can be charged into the interior volume portion of the SPA bathtub. That is to say, the operating unit 200 may include the gas path connecting pipe for surfing, and the number of gas path connecting pipes for surfing is not limited in the present disclosure.

Figure 3:
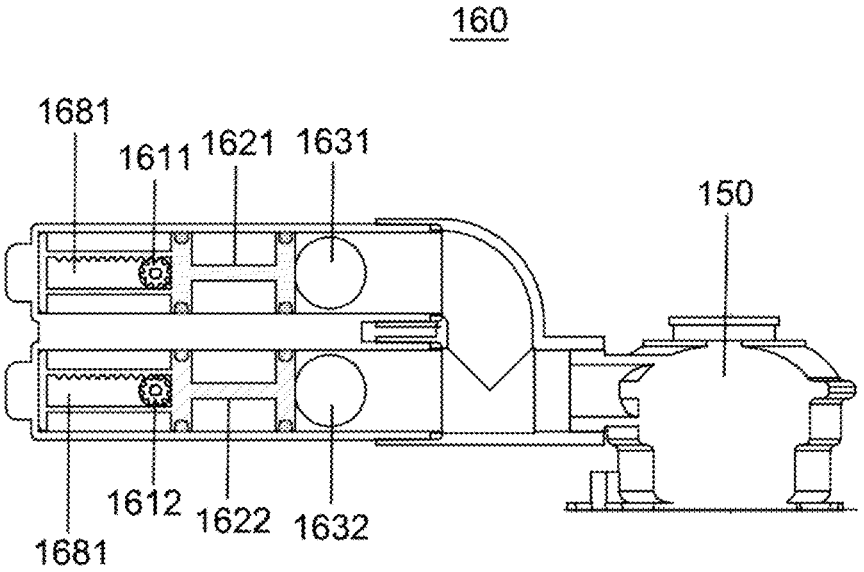
FIG. 3 shows a sectional view of two electric gas valves of the gas supply system of the operating unit for an SPA bathtub according to an exemplary embodiment of the present disclosure.

Referring to FIG. 3, it shows a sectional view of two electric gas valves of the gas supply system of the operating unit for an SPA bathtub according to an exemplary embodiment of the present disclosure. In some embodiments of the present disclosure, the operating unit 200 may include a first electric motor 1611 configured to drive a first moving piston 1621 provided in a first inner cavity 1681 in communication with the first gas path connecting pipe 1661, and a second electric motor 1612 configured to drive the second moving piston 1622 provided in the second inner cavity 1682 in communication with the second gas path connecting pipe 1662. The first electric motor 1611 and the second electric motor 1612 can be independently operated, and the first electric motor 1611 and the second electric motor 1612 can be configured to cooperate with each other in such a manner that: when the first electric motor 1611 is rotated in the first direction to drive the first moving piston 1621 to move towards the communication position, the second electric motor 1612 is not operated, or the second electric motor 1612 is rotated in the second direction to drive the second moving piston 1622 to move towards the off position; and when the second electric motor 1612 is rotated in the first direction to drive the second moving piston 1622 to move towards the communication position, the first electric motor 1611 is not operated, or the first electric motor 1611 is rotated in the second direction to drive the first moving piston 1621 to move towards the off position.

Referring to FIG. 1, in some embodiments of the present disclosure, the operating unit 200 further may include a gas pressure monitoring device 165 configured to detect the gas pressure inside the inflatable bathtub wall 410 (as shown in FIG. 9), and the gas pressure monitoring device 165 sends, when detecting that the gas pressure inside the inflatable bathtub wall 410 reaches or is greater than a predetermined gas pressure value, a signal to the control panel 110, so as to generate a physical operation command used for making the first electric motor 1611 rotate in the second direction so as to drive the first moving piston 1621 to move towards the off position.

Figure 4:
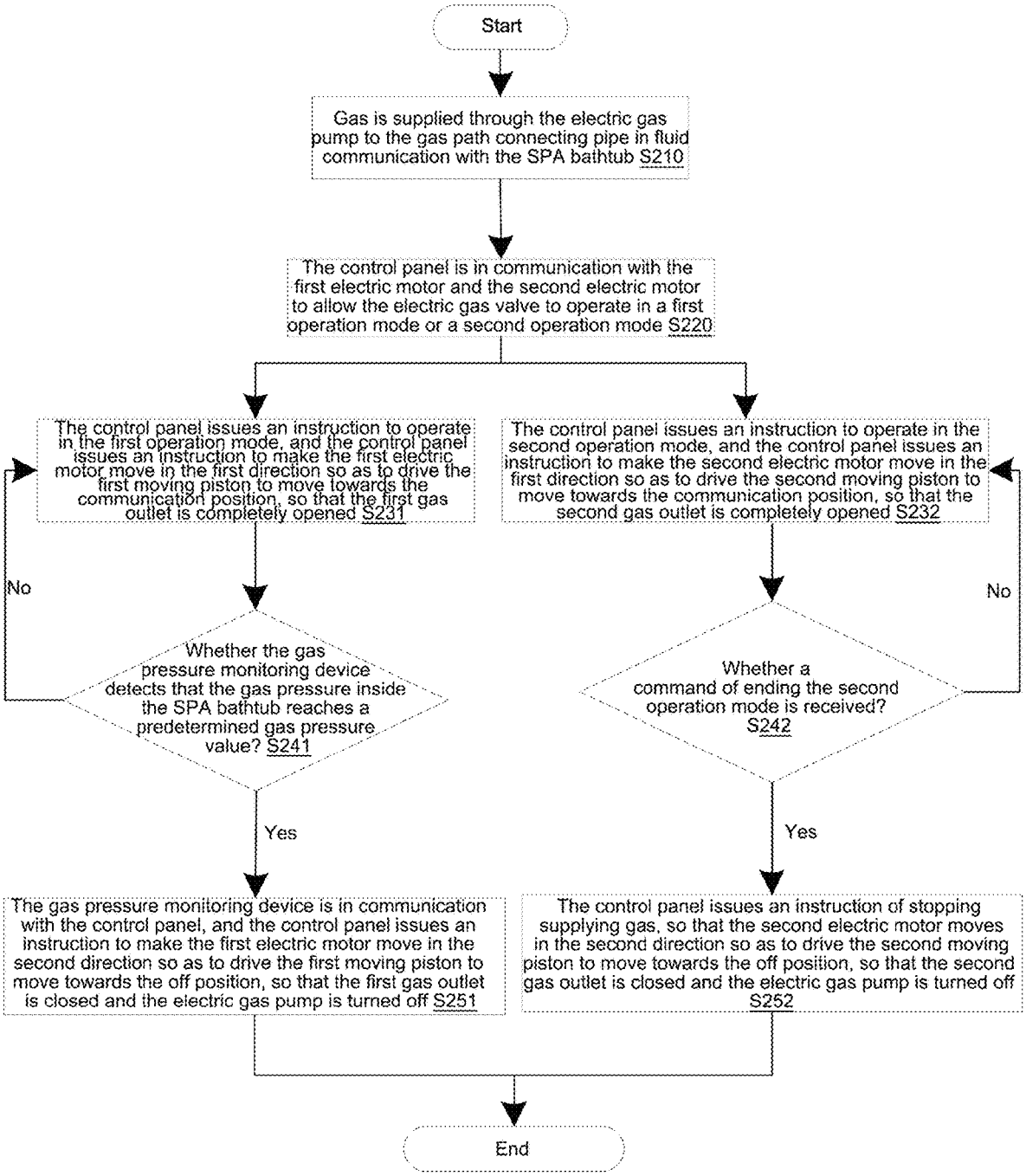
FIG. 4 shows a method of operating a gas supply system for an SPA bathtub according to an exemplary embodiment of the present disclosure.

FIG. 4 shows a method of operating a gas supply system for an SPA bathtub according to an exemplary embodiment of the present disclosure.

In some embodiments of the present disclosure, as shown in FIG. 4, a method of operating a gas supply system for an SPA bathtub according to the present disclosure may include the following steps. In step S210, a gas is supplied through the electric gas pump to the gas path connecting pipe in fluid communication with the SPA bathtub.

In step S220, the control panel is in communication with the first electric motor and the second electric motor to allow the electric gas valve to operate in a first operation mode or a second operation mode.

In step S231, the control panel issues an instruction to operate in the first operation mode, and the control panel issues an instruction to enable the first electric motor to move in the first direction, so as to drive the first moving piston to move towards the communication position, so that the first gas outlet is completely opened. In step S241, it is judged whether the gas pressure monitoring device detects that the gas pressure inside the SPA bathtub reaches or is greater than a predetermined gas pressure value. If a positive result is obtained in step S241 (i.e., a judgment result in S241 is "Yes"), the method flow proceeds to step S251. In step S251, the gas pressure monitoring device is in communication with the control panel, and the control panel issues an instruction to enable the first electric motor to move in the second direction so as to drive the first moving piston to move towards the off position, so that the first gas outlet is closed, and the electric gas pump is turned off.

In step S232, the control panel issues an instruction to operate in the second operation mode, and the control panel issues an instruction to enable the second electric motor to move in the first direction so as to drive the second moving piston to move towards the communication position, so that the second gas outlet is completely opened.

In step S242, it is judged whether an instruction of ending the second operation mode is received. If a positive result is obtained in step S242 (i.e., a judgment result in S242 is "Yes"), the method flow proceeds to step S252. In step S252, the control panel issues an instruction of stopping supplying gas, so that the second electric motor moves in the second direction so as to drive the second moving piston to move towards the off position, so that the second gas outlet is closed, and the electric gas pump is turned off.

If a negative result is obtained in step S242 (i.e., the judgment result in S242 is "No"), the method flow proceeds to step S232. The method flow proceeds to step S252 until a positive result is obtained in step S242.

In some embodiments of the present disclosure, the operating unit for an SPA bathtub may include a gas supply system configured to supply a gas to the bathtub. Alternatively, the operating unit may include only the gas supply system so as to supply gas to the bathtub. The operating unit is as described in detail with reference to FIG. 5 to FIG. 8. In addition, those skilled in the art could use the operating unit according to some embodiments of the present disclosure for a storage device according to actual needs, wherein the storage device is configured to store a fluid, especially water. The operating unit is configured to supply gas to the fluid in the storage device. In particular, the operating unit may supply the storage device with gas in one or more modes (e.g. inflation mode or surf mode).

The method of operating a gas supply system for an SPA bathtub according to an exemplary embodiment of the present disclosure, through the design of the moving piston in the electric gas valve in the operating unit for an SPA bathtub, realizes that large flow of gas can be supplied when using the electric gas pump to supply gas, meanwhile also reduces the resistance to the electric gas pump, and thus can improve the efficiency of supplying gas to the bathtub.

Figure 5:
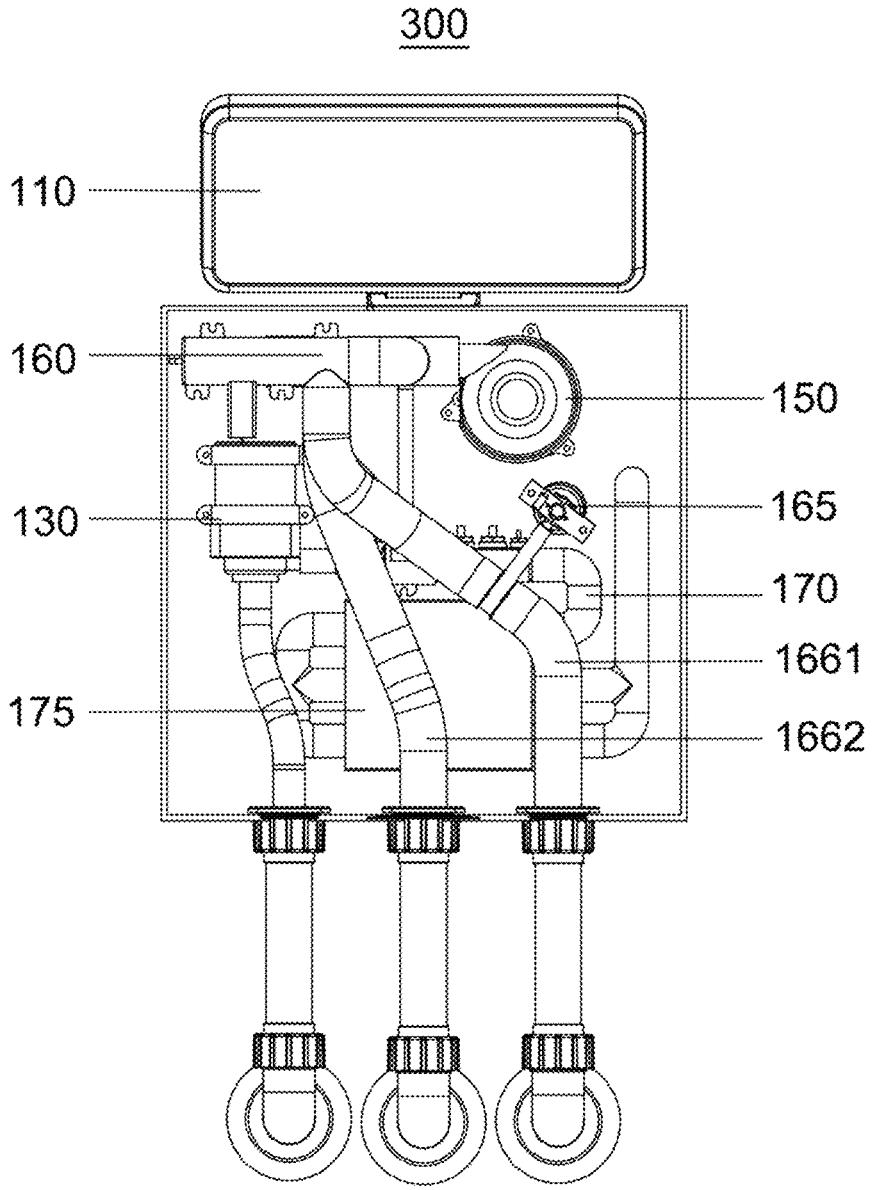
FIG. 5 shows a schematic view of the operating unit for an SPA bathtub according to another exemplary embodiment of the present disclosure, wherein the operating unit includes a water circulation system and a gas supply system.

FIG. 5 shows a schematic view of the operating unit for an SPA bathtub according to another exemplary embodiment of the present disclosure, wherein the operating unit includes a gas supply system and a water circulation system.

The operating unit 300 for an SPA bathtub according to another exemplary embodiment of the present disclosure may include the gas supply system of the operating unit 200 for an SPA bathtub according to an exemplary embodiment of the present disclosure, and in addition, the operating unit further may include the water circulation system of the operating unit 100 for an SPA bathtub, as will be described in detail below with reference to FIG. 6 to FIG. 8. The gas supply system of the operating unit 200 for an SPA bathtub described in accordance with some embodiments of the present disclosure is described in detail below in connection with FIG. 1 to FIG. 4, and is not repeated herein again. The water circulation system of the operating unit 100 for an SPA bathtub described in accordance with some embodiments of the present disclosure is described in detail with reference to FIG. 6 to FIG. 8.

Figure 6:
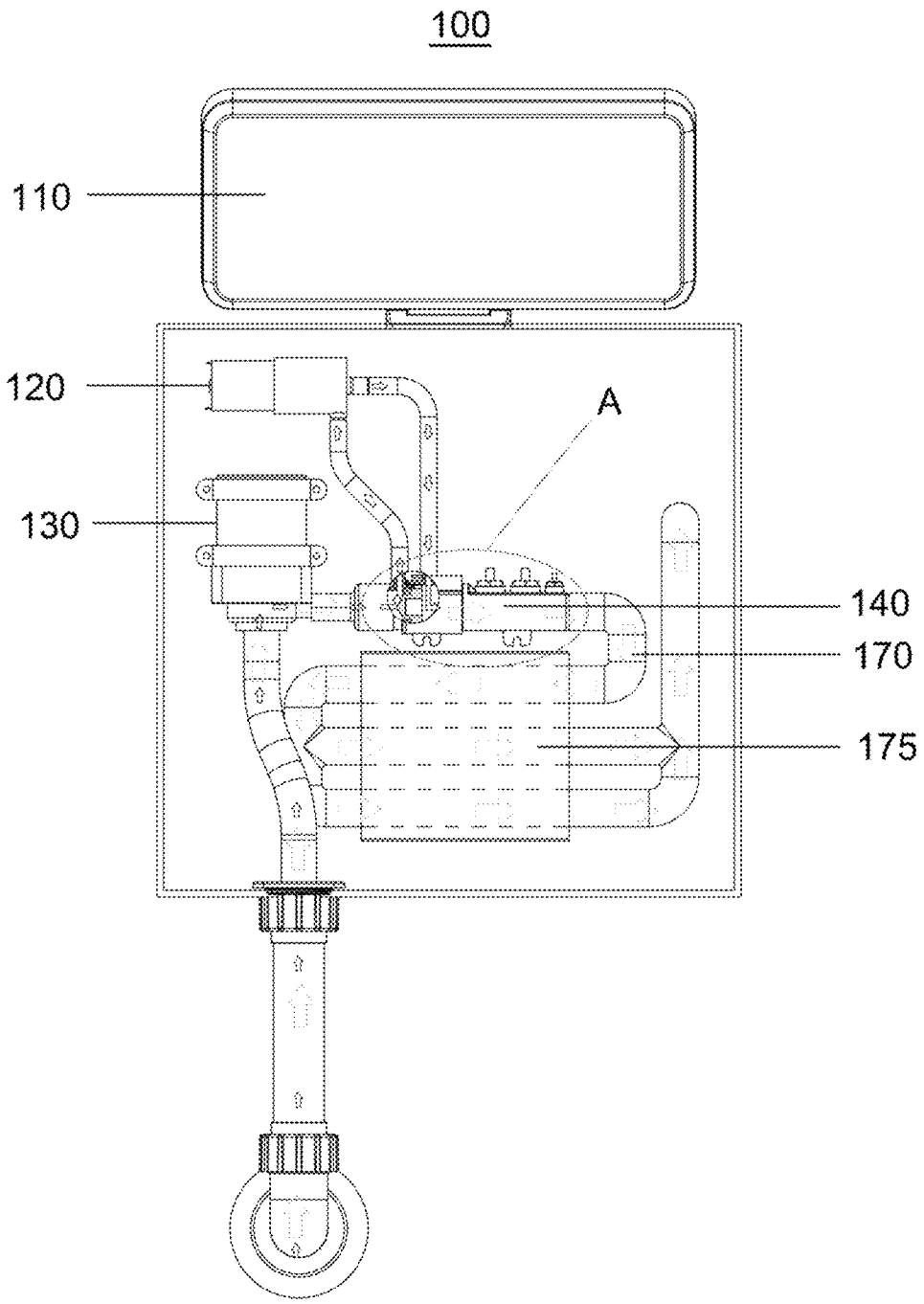
FIG. 6 shows a schematic view of the operating unit for an SPA bathtub according to an exemplary embodiment of the present disclosure.

FIG. 6 shows a schematic view of the operating unit for an SPA bathtub according to an exemplary embodiment of the present disclosure.

As shown in FIG. 6, the operating unit 100 for an SPA bathtub according to an exemplary embodiment of the present disclosure can be detachably attached to the SPA bathtub. The operating unit 100 further may include a fluid circulation system for performing out-of-bathtub circulation on a fluid in the SPA bathtub. The fluid circulation system may include a diaphragm self-priming pump 120, a peristaltic pump 130, a fluid circulation pipeline 170, and a fluid switch assembly 140 connecting the diaphragm self-priming pump 120 and the peristaltic pump 130 with the fluid circulation pipeline 170. The peristaltic pump 130 may be provided in such a manner that: an inlet of the peristaltic pump 130 can be in fluid communication with an interior volume portion of the SPA bathtub and an outlet of the peristaltic pump 130 is in fluid communication with an inlet of the fluid switch assembly 140. The diaphragm self-priming pump 120 may be provided in such a manner that an inlet of the diaphragm self-priming pump 120 is in fluid communication with the outlet of the peristaltic pump 130 and an outlet of the diaphragm self-priming pump 120 can be in fluid communication with an outlet of the fluid switch assembly 140. The fluid circulation pipeline 170 may be provided in such a manner that: an inlet of the fluid circulation pipeline 170 is in fluid communication with the outlet of the fluid switch assembly 140; and the outlet of the fluid circulation pipeline 170 is in fluid communication with the interior volume portion of the SPA bathtub. The diaphragm self-priming pump 120, the peristaltic pump 130, and the fluid switch assembly 140 are configured to cooperate with each other in such a manner that: the diaphragm self-priming pump 120 operates before the peristaltic pump 130 operates normally and stops operating after the peristaltic pump 130 operates normally, and the fluid switch assembly 140 has a first operation state and a second operation state, wherein during the operation of the diaphragm self-priming pump 120, the fluid switch assembly 140 is in the first operation state, so that the fluid from the interior volume portion of the SPA bathtub flows through the peristaltic pump 130, the diaphragm self-priming pump 120, the fluid switch assembly 140, and the fluid circulation pipeline 170 in sequence and finally returns back to the interior volume portion of the SPA bathtub; and during the operation of the peristaltic pump 130, the fluid switch assembly 140 is in the second operation state, so that the fluid from the interior volume portion of the SPA bathtub flows through the peristaltic pump 130, the fluid switch assembly 140, and the fluid circulation pipeline 170 in sequence and finally returns back to the interior volume portion of the SPA bathtub.

For the water circulation system of the operating unit for an SPA bathtub according to an exemplary embodiment of the present disclosure, through the cooperation between the diaphragm self-priming pump, the peristaltic pump, and the fluid switch assembly, the installation and the use of the water circulation system of the bathtub are no longer restricted by the water level in the bathtub, and the water circulation of the water in the SPA bathtub still can be realized even in the case of a low water level, thus assisting in realizing the function of heating or filtering the water in the SPA bathtub. The operating unit for an SPA bathtub according to the exemplary embodiment of the present disclosure is easier to install and use, and has wider application scenarios.

Figure 7:
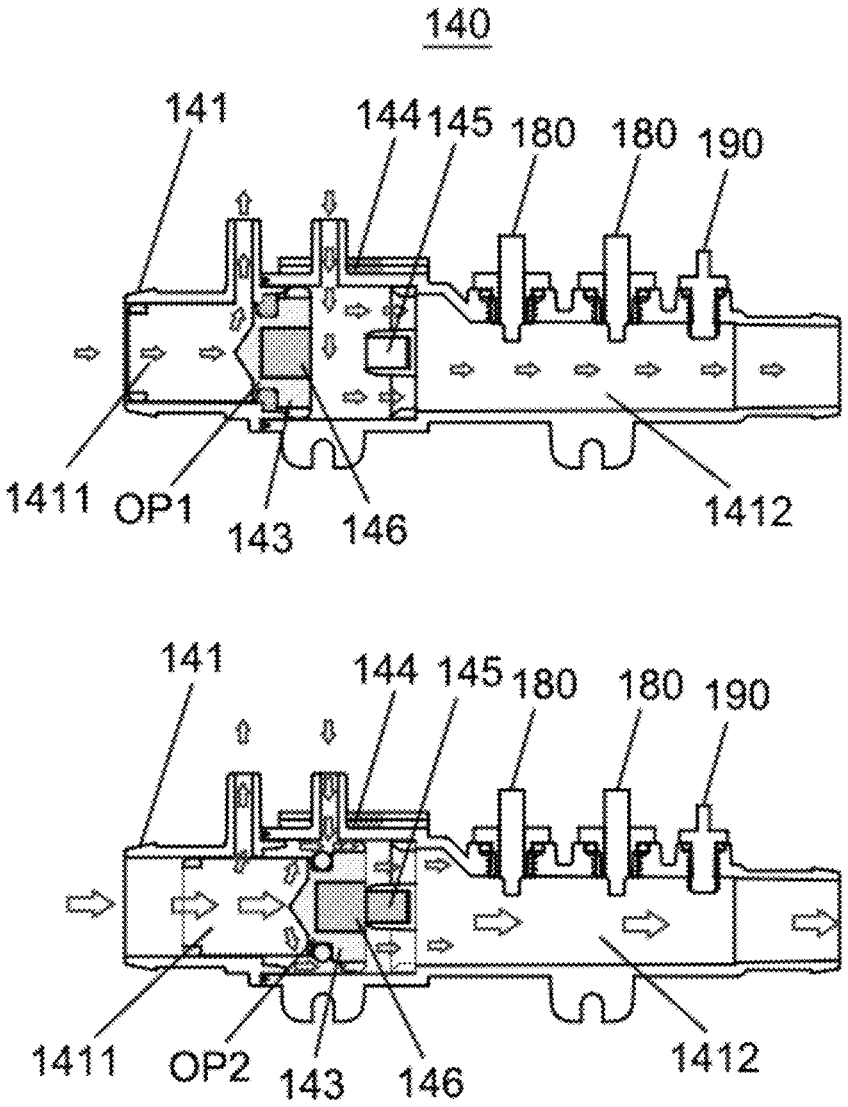
FIG. 7 shows schematic diagrams of working principle of a fluid switch assembly in a water circulation system of the operating unit for an SPA bathtub according to an exemplary embodiment of the present disclosure.

FIG. 7 shows schematic diagrams of working principle of a fluid switch assembly in the water circulation system of an operating unit for an SPA bathtub according to an exemplary embodiment of the present disclosure, and FIG. 7 shows partially enlarged views of portion A of FIG. 6 for the fluid switch assembly. In some embodiments of the present disclosure, the fluid switch assembly 140 may include a housing member 141, and a first cavity 1411 and a second cavity 1412 are provided in the housing member 141 along a longitudinal direction of the housing member 141. The first cavity 1411 and the second cavity 1412 are in fluid communication with each other via a first opening, the outlet of the peristaltic pump 130 and the inlet of the diaphragm self-priming pump 120 are in fluid communication with the first cavity 1411, and the outlet of the diaphragm self-priming pump 120 and the inlet of the water circulation pipeline 170 are in fluid communication with the second cavity 1412. The fluid switch assembly 140 further may include a fluid switch piston 143, and the fluid switch piston 143 is received in the second cavity 1412 and can move in the second cavity 1412. During operation of the diaphragm self-priming pump 120, the fluid switch piston 143 is located in a first operating position OP1 so as to close the first opening; and during operation of the peristaltic pump 130, the fluid switch piston 143 moves from the first operating position OP1 to a second operating position OP2 where fluid communication between the first cavity 1411 and the second cavity 1412 is allowed.

With continued reference to FIG. 6 and FIG. 7, in some embodiments of the present disclosure, the fluid switch assembly 140 further may include: at least one first magnet 145 positioned in the second cavity 1412, and at least one second magnet 146 positioned on the fluid switch piston 143 and opposite to the first magnet 145, the first magnet 145 and the second magnet 146 may be provided in such a manner that ends having the same polarity are opposite to each other. The interaction force between the first magnet 145 and the second magnet 146 may be set to be suitable for maintaining the fluid switch piston 143 in the first operating position OP1 and less than an operating fluid pressure of the peristaltic pump 130.

In some embodiments of the present disclosure, the fluid switch assembly 140 further may include a biasing device (not shown) mounted in the second cavity 1412, and the biasing device abuts against the fluid switch piston 143 and applies a biasing force to the fluid switch piston 143 towards the first operating position OP1. The sum of the biasing force and the interaction force between the first magnet 145 and the second magnet 146 is less than the operating fluid pressure of the peristaltic pump 130.

Referring to FIG. 6, in some embodiments of the present disclosure, the operating unit 100 further may include a heater 175 configured to heat the water circulation pipeline 170, and particularly, the heater 175 is a PTC (Positive Temperature Coefficient Ceramic) heater. The heater 175 is in communication with the control panel 110, and the plurality of sensors may include an inductor 144 provided at an outside of the housing member 141. The inductor 144 may be positioned close to an end of the first magnet 145 facing the second magnet 146 and may be configured to: send a first output signal to the control panel 110 when a distance between the second magnet 146 and the first magnet 145 is less than or equal to a preset spacing value, so as to generate an operation command used to make the heater 175 start operating, and send a second output signal to the control panel 110 when the distance between the second magnet 146 and the first magnet 145 is greater than the preset spacing value, so as to generate an operation command used to make the heater 175 stop operating.

For the water circulation system of an operating unit for an SPA bathtub according to an exemplary embodiment of the present disclosure, through the design of at least one first magnet and at least one second magnet in the fluid switch assembly, when the water flow and the water pressure are insufficient, the fluid switch piston leaves the first magnet due to the interaction force between the first magnet and the second magnet and leaves the inductor, and the inductor notifies the control panel to send a signal used for stopping heating, when the distance between the second magnet and the first magnet is greater than the preset spacing value, thus preventing dry burning and overheating of the heater, so that the use of the bathtub is more safe and more reliable.

Referring to FIG. 7, in some embodiments of the present disclosure, the plurality of sensors further may include at least one temperature sensor 180 and/or a leakage inductor 190 provided on the housing member 141 of the fluid switch assembly 140. The leakage inductor 190 may be configured to send a signal to the control panel 110 when sensing that a current having a value greater than a preset current value is present in the water flowing through the fluid switch assembly 140, to generate an operation command used to make the operating unit 100 powered off. The at least one temperature sensor is configured to send a signal to the control panel 110 when the temperature of the water flowing through the fluid switch assembly 140 is higher than a preset temperature value, to generate the operation command used to make the heater 175 stop operating.

In the operating unit for an SPA bathtub according to an exemplary embodiment of the present disclosure, the system further includes a leakage inductor provided in the water circulation system, and the leakage inductor sends a signal to the system, when sensing that a current having a value greater than a preset current value is present in the water flowing through the fluid switch assembly, so that the system is powered off, thereby making the use of the SPA bathtub according to the embodiment of the present disclosure more safe.

Figure 8:
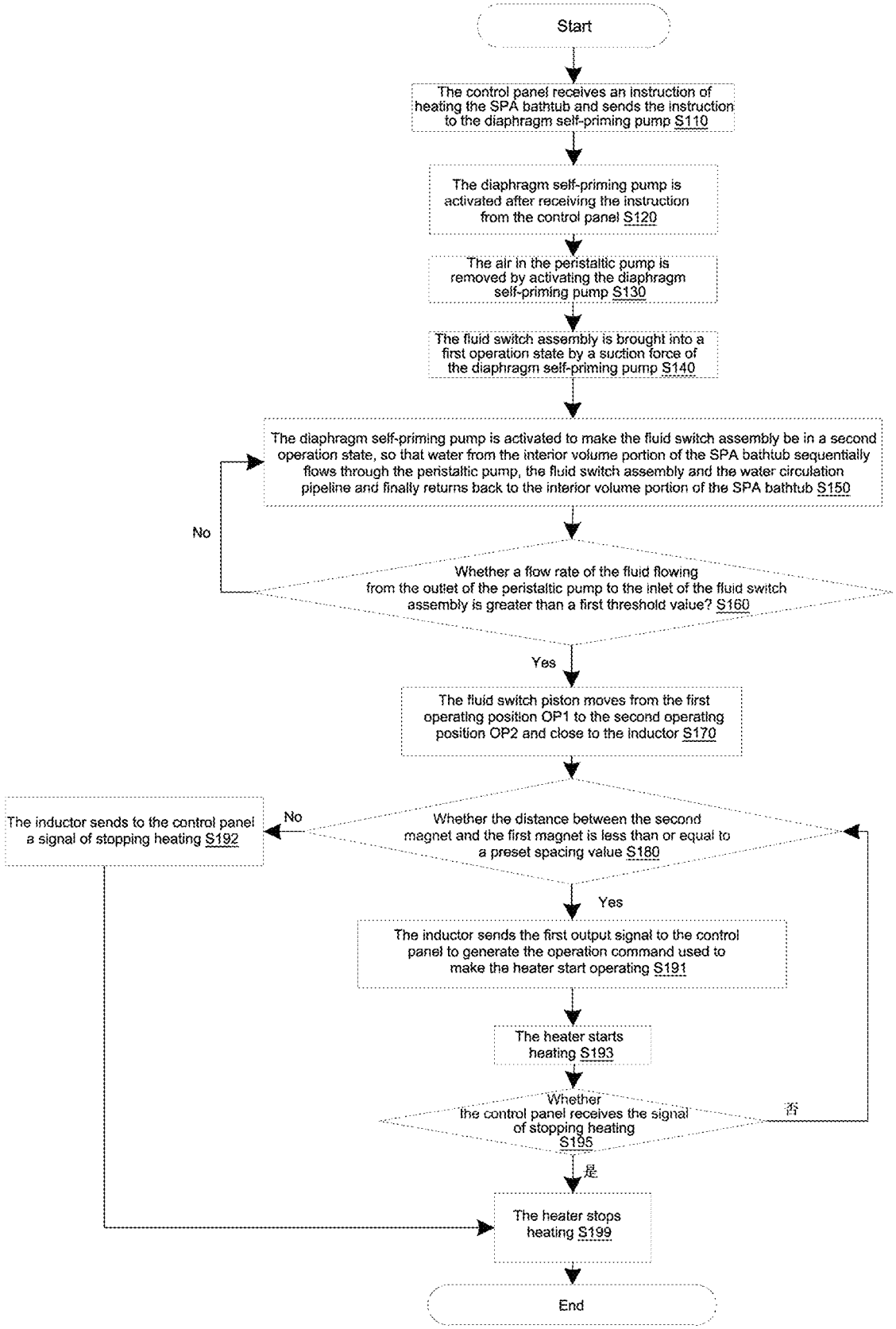
FIG. 8 shows a method of operating the water circulation system for an SPA bathtub according to an exemplary embodiment of the present disclosure.

FIG. 8 shows a method of operating a water circulation system of an SPA bathtub according to an exemplary embodiment of the present disclosure.

In some embodiments of the present disclosure, as shown in FIG. 8, a method of operating an SPA bathtub according to the present disclosure may include the following steps. In step S110, the control panel receives an instruction of heating the SPA bathtub and sends the instruction to the diaphragm self-priming pump. In step S120, after receiving the instruction from the control panel, the diaphragm self-priming pump is activated. In step S130, the air in the peristaltic pump is removed by activating the diaphragm self-priming pump, so that the peristaltic pump operates normally. In step S140, the fluid switch assembly is brought into the first operation state by a suction force of the diaphragm self-priming pump, so that the water from the interior volume portion of the SPA bathtub flows through the peristaltic pump, the diaphragm self-priming pump, the fluid switch assembly, and the water circulation pipeline in sequence and finally returns back to the interior volume portion of the SPA bathtub. In step S150, the diaphragm self-priming pump is activated, so that the fluid switch assembly is brought into the second operation state, so that the water from the interior volume portion of the SPA bathtub flows through the peristaltic pump, the fluid switch assembly, and the water circulation pipeline in sequence and finally returns back to the interior volume portion of the SPA bathtub.

In step S160, it is judged whether a flow rate of the fluid flowing from the outlet of the peristaltic pump to the inlet of the fluid switch assembly is greater than a first threshold value. Specifically, when the flow rate of the fluid flowing from the outlet of the peristaltic pump to the inlet of the fluid switch assembly is greater than the first threshold value, the fluid pressure in the peristaltic pump is greater than the sum of the biasing force and the interaction force between the first magnet and the second magnet, so that the fluid switch piston moves from the first operating position OP1 to the second operating position OP2. If a positive result is obtained in step S160 (i.e., a judgment result in S160 is "Yes"), the method flow proceeds to step S170. If a negative result is obtained in step S160 (i.e., the judgment result in S160 is "No"), the method flow returns back to step S150. The method flow proceeds to step S160 until a positive result is obtained in step S160.

For the method of operating an SPA bathtub according to an exemplary embodiment of the present disclosure, through the cooperation between the diaphragm self-priming pump, the peristaltic pump, and the fluid switch assembly of the operating unit for an SPA bathtub, the installation and the use of the water circulation system of the bathtub are no longer restricted by the water level in the bathtub, and the water circulation of the water in the SPA bathtub also can be realized even in the case of a low water level, thus assisting in realizing the function of heating or filtering the water in the SPA bathtub, so that the problem of having to be installed at a low water level is resolved in the related technical field. The operating unit for an SPA bathtub according to the exemplary embodiment of the present disclosure is easier to install and use, and has wider application scenarios.

With continued reference to FIG. 8, the method of operating a water circulation system of an SPA bathtub according to an exemplary embodiment of the present disclosure further includes: in step S170, the fluid switch piston moves from the first operating position OP1 to the second operating position OP2 and is close to the inductor. In step S180, it is judged whether the distance between the second magnet and the first magnet is less than or equal to a preset spacing value. Specifically, when the distance between the second magnet and the first magnet is less than or equal to the preset spacing value, the inductor sends the first output signal to the control panel to generate the operation command used to make the heater start operating. If a positive result is obtained in step S180 (i.e., a judgment result in S180 is "Yes"), the method flow proceeds to step S191. If a negative result is obtained in step S180 (i.e., the judgment result in S180 is "No"), the method flow proceeds to step S192.

In step S191, the inductor sends the first output signal to the control panel to generate the operation command used to make the heater start operating. After step S191, the method flow proceeds to step S193. In step S193, the heater starts heating. After step S193, the method flow proceeds to step S195. In step S195, it is judged whether the control panel receives the signal of stopping heating. If a judgment result in step S195 is "Yes", the method flow proceeds to step S199, and the heater stops heating. If the judgment result in step S195 is "No", the method flow returns back to step S180, and continues to judge whether the distance between the second magnet and the first magnet is less than or equal to the preset spacing value. In step S192, the inductor notifies the control panel to send a signal of stopping heating. Then the method flow proceeds to step S199, and the heater stops heating.

In some embodiments of the present disclosure, the operating unit is configured for use in an SPA bathtub. In addition, those skilled in the art could use, according to actual needs, the operating unit according to some embodiments of the present disclosure for a storage device, wherein the storage device is configured to store a fluid, especially water. The operating unit is configured to fluidly circulate the fluid in the storage device to assist in heating or filtering the fluid in the storage device.

For the water circulation system of an operating unit for an SPA bathtub according to an exemplary embodiment of the present disclosure, by using the design of at least one first magnet and at least one second magnet in the fluid switch assembly, when the water flow and the water pressure are insufficient, the fluid switch piston leaves the first magnet due to the interaction force between the first magnet and the second magnet and leaves the inductor, and the inductor notifies, when the distance between the second magnet and the first magnet is greater than the preset spacing value, the control panel to send the signal of stopping heating, thus preventing dry burning and overheating of the heater, so that the use of the bathtub is more safe and more reliable.

In some embodiments of the present disclosure, the operating unit 200 can be provided outside the SPA bathtub 400 in a threaded connection manner, or through a hooking device; and alternatively, the operating unit can be provided inside a bathtub wall of the SPA bathtub 400 in an embedded manner, as described in detail with reference to FIG. 9.

The operating unit for an SPA bathtub according to an exemplary embodiment of the present disclosure may have a fixed style, can be used with more kinds of bathtubs, can be provided outside the SPA bathtub in a threaded connection manner, or through a hooking device, and alternatively, the operating unit can be provided inside a bathtub wall of the SPA bathtub in an embedded manner, then it has richer usage scenarios, and wider application scenes, and meanwhile reduces the cost of repeated molding.

Referring to FIG. 9, FIG. 9 shows the SPA bathtubs according to exemplary embodiments of the present disclosure. Further embodiments of the present disclosure provide an SPA bathtub 400, wherein the SPA bathtub 400 may include the operating unit 100, 200, 300 according to embodiments of the present disclosure.

As shown in FIG. 9, the SPA bathtub of an exemplary embodiment of the present disclosure includes the operating unit 100, 200, 300 for an SPA bathtub according to some embodiments of the present disclosure, wherein the operating unit 100, 200, 300 can be provided outside the SPA bathtub 400 in a threaded connection manner, or through a hooking device, and alternatively, the operating unit can be provided inside a bathtub wall of the SPA bathtub 400 in an embedded manner, as described in detail with reference to FIG. 9.

(A) of FIG. 9 shows an installation form of a skeleton bathtub, and the operating unit for controlling a bathtub according to an exemplary embodiment of the present disclosure can be provided inside the SPA bathtub in an embedded manner. (B) of FIG. 9 to (D) of FIG. 9 show installation forms of an inflatable bathtub 400, and as shown in (B) of FIG. 9 to (D) of FIG. 9, the inflatable bathtub 400 includes an inflatable bathtub wall 410. (B) of FIG. 9 shows an external installation form of an inflatable bathtub, and the operating unit for controlling a bathtub according to an exemplary embodiment of the present disclosure can be provided outside the SPA bathtub 400 in a threaded connection manner. (C) of FIG. 9 shows an external installation form of an inflatable bathtub, and the operating unit for controlling a bathtub according to an exemplary embodiment of the present disclosure can be provided outside the SPA bathtub 400 through a hooking device. (D) of FIG. 9 shows an built-in installation form of an inflatable bathtub, and the operating unit for controlling a bathtub according to an exemplary embodiment of the present disclosure can be provided inside the bathtub wall 410 of the SPA bathtub in an embedded manner.

The SPA bathtub according to the embodiments of the present disclosure at least can realize the following technical effects: through the design of the moving piston in the electric gas valve in the operating unit for an SPA bathtub, it is realized that large flow of gas can be supplied when using the electric gas pump to supply gas, and meanwhile the resistance to the electric gas pump is also reduced, thereby improving efficiency of supplying gas to the bathtub; besides, by using the operating unit according to the embodiments of the present disclosure, the use of the bathtub is no longer restricted by the water level in the bathtub, so that water circulation of the water in the SPA bathtub still can be realized even in the case of a low water level, thereby assisting in realizing the function of heating or filtering of the water in the SPA bathtub, so that the problem of having to be installed at a low water level is resolved in the related technical field; and the installation of the operating unit for an SPA bathtub according to an exemplary embodiment of the present disclosure no longer needs a fixed height, and the installation and use are easier. The operating unit for an SPA bathtub according to an exemplary embodiment of the present disclosure may have a fixed style, and can be used with more kinds of bathtubs, then it has richer usage scenarios, and wider application scenes, and meanwhile reduces the cost of repeated molding.

Although the present disclosure has been described with reference to exemplary embodiments, it should be understood that the present disclosure is not limited to the specific embodiments described and illustrated in detail herein. Those skilled in the art could make various changes to the exemplary embodiments without departing from the scope defined by the claims of the present disclosure.

Features mentioned and/or shown in the description of exemplary embodiments of the present disclosure in the above may be incorporated into one or more other embodiments in the same or similar manner, and combined with the features in other embodiments or replace corresponding features in other embodiments. These technical solutions obtained through combination or replacement should also be considered as being included in the scope of protection of the present disclosure.

What is claimed is:

1. An operating unit for an SPA bathtub, wherein the operating unit is detachably attached to the SPA bathtub, and the operating unit comprises a gas supply system configured to supply a gas to the SPA bathtub, the gas supply system comprises an electric gas pump, an electric gas valve, and at least one gas path connecting pipe, the electric gas pump is configured to be able to be in fluid communication with the SPA bathtub through the electric gas valve and the at least one gas path connecting pipe, the electric gas valve comprises a valve housing defining at least one inner cavity, wherein the valve housing is provided with a gas inlet configured to be in communication with the electric gas pump, and at least one gas outlet each configured to be in communication with corresponding one of the at least one gas path connecting pipe, wherein the at least one inner cavity is each in fluid communication with a corresponding gas path connecting pipe via a corresponding gas outlet, and each inner cavity is provided therein with a moving piston, and the electric gas pump and the electric gas valve are configured to cooperate with each other in such a manner that: during operation of the electric gas pump, the moving piston in the electric gas valve is located in a communication position such that the corresponding gas outlet is opened to allow fluid communication between the electric gas pump and the gas path connecting pipe, and when the electric gas pump stops operating, the moving piston in the electric gas valve is located in an off position where the corresponding gas outlet is closed to block the fluid communication between the electric gas pump and the gas path connecting pipe, wherein the operating unit further comprises a fluid circulation system configured for performing out-of-bathtub circulation on a fluid in the SPA bathtub, the fluid circulation system comprises a diaphragm self-priming pump, a peristaltic pump, a fluid circulation pipeline, and a fluid switch assembly connecting the diaphragm self-priming pump and the peristaltic pump with the fluid circulation pipeline, the peristaltic pump is provided in such a manner that an inlet of the peristaltic pump can be in fluid communication with the interior volume portion of the SPA bathtub and an outlet of the peristaltic pump is in fluid communication with an inlet of the fluid switch assembly, the diaphragm self-priming pump is provided in such a manner that an inlet of the diaphragm self-priming pump is in fluid communication with the outlet of the peristaltic pump and an outlet of the diaphragm self-priming pump can be in fluid communication with an outlet of the fluid switch assembly, and the fluid circulation pipeline is provided in such a manner that an inlet of the fluid circulation pipeline is in fluid communication with the outlet of the fluid switch assembly and an outlet of the fluid circulation pipeline is in fluid communication with the interior volume portion of the SPA bathtub, and the diaphragm self-priming pump, the peristaltic pump, and the fluid switch assembly are configured to cooperate with each other in such a manner that: the diaphragm self-priming pump operates before the peristaltic pump operates normally and stops operating after the peristaltic pump operates normally, and the fluid switch assembly has a first operation state and a second operation state, wherein during operation of the diaphragm self-priming pump, the fluid switch assembly is in the first operation state, so that the fluid from the interior volume portion of the SPA bathtub flows through the peristaltic pump, the diaphragm self-priming pump, the fluid switch assembly, and the fluid circulation pipeline in sequence and finally returns back to the interior volume portion of the SPA bathtub, and during operation of the peristaltic pump, the fluid switch assembly is in the second operation state, so that the fluid from the interior volume portion of the SPA bathtub flows through the peristaltic pump, the fluid switch assembly, and the fluid circulation pipeline in sequence and finally returns back to the interior volume portion of the SPA bathtub.

2. The operating unit according to claim 1, wherein the operating unit can be provided outside the SPA bathtub in a threaded connection manner, or through a hooking device; and alternatively, the operating unit can be provided inside a bathtub wall of the SPA bathtub in an embedded manner.

3. An SPA bathtub, wherein the SPA bathtub comprises the operating unit according to claim 1.

4. The operating unit according to claim 1, wherein the fluid switch assembly comprises a housing member, a first cavity and a second cavity are provided in the housing member along a longitudinal direction of the housing member, the first cavity and the second cavity are in fluid communication with each other via a first opening, the outlet of the peristaltic pump and the inlet of the diaphragm self-priming pump are both in fluid communication with the first cavity, the outlet of the diaphragm self-priming pump and the inlet of the fluid circulation pipeline are both in fluid communication with the second cavity, the fluid switch assembly further comprises a fluid switch piston, the fluid switch piston is received in the second cavity and movable in the second cavity, wherein during the operation of the diaphragm self-priming pump, the fluid switch piston is located in a first operating position so as to close the first opening, and during the operation of the peristaltic pump, the fluid switch piston moves from the first operating position to a second operating position where fluid communication between the first cavity and the second cavity is allowed.

5. The operating unit according to claim 4, wherein the fluid switch assembly further comprises at least one first magnet positioned in the second cavity and at least one second magnet positioned on the fluid switch piston and opposite to the first magnet, the first magnet and the second magnet are provided in such a manner that ends having the same polarity are opposite to each other, and an interaction force between the first magnet and the second magnet is set to be suitable for maintaining the fluid switch piston in the first operating position and is less than an operating fluid pressure of the peristaltic pump.

6. The operating unit according to claim 5, wherein the fluid switch assembly further comprises a biasing device mounted in the second cavity, the biasing device abuts against the fluid switch piston and applies a biasing force to the fluid switch piston towards the first operating position, and a sum of the biasing force and the interaction force between the first magnet and the second magnet is less than the operating fluid pressure of the peristaltic pump.

7. The operating unit according to claim 6, wherein the operating unit further comprises a heater configured to heat the fluid circulation pipeline, the heater is in communication with the control panel, the plurality of sensors comprise an inductor provided at an outside of the housing member, the inductor is positioned close to an end of the first magnet facing the second magnet and is configured to: send a first output signal to the control panel when a distance between the second magnet and the first magnet is less than or equal to a preset spacing value, so as to generate an operation command used to make the heater start operating, and send a second output signal to the control panel when the distance between the second magnet and the first magnet is greater than the preset spacing value, so as to generate an operation command used to make the heater stop operating.

8. The operating unit according to claim 7, wherein the plurality of sensors further comprise at least one temperature sensor and/or a leakage inductor provided on the housing member of the fluid switch assembly, the leakage inductor is configured to send a signal to the control panel when sensing that a current having a value greater than a preset current value is present in the fluid flowing through the fluid switch assembly, to generate an operation command used to make the operating unit powered off, and the at least one temperature sensor is configured to send a signal to the control panel when a temperature of the fluid flowing through the fluid switch assembly is higher than a preset temperature value, to generate an operation command used to make the heater stop operating.

9. The operating unit according to claim 1, wherein the electric gas valve further comprises an electric motor positioned on the valve housing and configured for driving the moving piston, the electric motor is configured to be rotatable in a first direction and a second direction opposite to each other and comprises a driving gear on an output shaft of the electric motor, wherein the moving piston is configured to be coupled to a rack configured to be meshed with the driving gear of the electric motor, such that through meshing between the driving gear and the rack, the moving piston can move towards the communication position when the electric motor is rotated in the first direction, and move towards the off position when the electric motor is rotated in the second direction.

10. The operating unit according to claim 9, wherein the operating unit further comprises a plurality of sensors and a control panel in communication with the plurality of sensors, the plurality of sensors are configured to measure an operation state of the SPA bathtub and send to the control panel a signal indicating an operation state of the SPA bathtub, and the control panel is configured to receive an external input instruction of controlling operation of the SPA bathtub and the signal indicating the operation state of the SPA bathtub from the plurality of sensors, and generate for the SPA bathtub a physical operation command according to the external input instruction and the signal.

11. The operating unit according to claim 10, wherein the SPA bathtub comprises an inflatable bathtub wall, the operating unit comprises at least one gas path connecting pipe in communication with an inner cavity of the electric gas valve, each gas path connecting pipe is configured to be capable of being connected to the inflation valve of the inflatable bathtub wall, so that the gas from the electric gas pump can be charged into an interior of the inflatable bathtub wall via the inflation valve.

12. The operating unit according to claim 10, wherein the operating unit comprises at least one gas path connecting pipe in communication with the inner cavity of the electric gas valve, and each of the at least one gas path connecting pipe is configured to be capable of being in fluid communication with the interior volume portion of the SPA bathtub, so that the gas from the electric gas pump can be charged into the interior volume portion of the SPA bathtub.

13. The operating unit according to claim 10, wherein the electric gas pump and the electric gas valve are respectively in communication with the control panel and configured to cooperate with each other in such a manner that: when the electric gas pump receives from the control panel an operation command of stopping operating, the moving piston in the electric gas valve moves towards an off position where the corresponding gas outlet is closed to block the fluid communication between the electric gas pump and the gas path connecting pipe, and the electric gas pump stops operating when the moving piston in the electric gas valve reaches the off position.

14. The operating unit according to claim 13, wherein a stop portion is provided in each inner cavity of the valve housing, and the stop portion is configured such that the moving piston completely closes the gas outlet when abutting against the stop portion, and the electric motor is in communication with the control panel, and the electric motor is configured to cooperate with the electric gas pump in such a manner that when the electric gas pump receives the operation command of stopping operating, the moving piston is enabled by the electric motor to move back to a state of abutting against the stop portion.

15. The operating unit according to claim 14, wherein the SPA bathtub comprises an inflatable bathtub wall, the operating unit comprises at least one gas path connecting pipe in communication with an inner cavity of the electric gas valve, each gas path connecting pipe is configured to be capable of being connected to the inflation valve of the inflatable bathtub wall, so that the gas from the electric gas pump can be charged into an interior of the inflatable bathtub wall via the inflation valve.

16. The operating unit according to claim 10, wherein one or more of the at least one gas path connecting pipe are configured to be capable of being in fluid communication with an interior volume portion of the SPA bathtub.

17. The operating unit according to claim 16, wherein the SPA bathtub comprises an inflatable bathtub wall and the interior volume portion enclosed by the inflatable bathtub wall, the operating unit comprises two gas path connecting pipes respectively in communication with two inner cavities of the electric gas valve, a first gas path connecting pipe in the two gas path connecting pipes is configured to be capable of being connected with an inflation valve of the inflatable bathtub wall, so that the gas from the electric gas pump can be charged into an interior of the inflatable bathtub wall via the inflation valve to inflate the inflatable bathtub wall, and a second gas path connecting pipe in the two gas path connecting pipes is configured to be capable of being in fluid communication with the interior volume portion of the SPA bathtub, so that the gas from the electric gas pump can be supplied into the interior volume portion of the inflatable SPA bathtub.

18. The operating unit according to claim 17, wherein the operating unit comprises a first electric motor configured to drive a first moving piston provided in a first inner cavity in communication with the first gas path connecting pipe, and a second electric motor configured to drive a second moving piston provided in a second inner cavity in communication with the second gas path connecting pipe, and the first electric motor and the second electric motor are configured to be able to be independently operated, and the first electric motor and the second electric motor are configured to cooperate with each other in such a manner that: when the first electric motor is rotated in the first direction to drive the first moving piston to move towards the communication position, the second electric motor is not operated, or the second electric motor is rotated in the second direction to drive the second moving piston to move towards the off position; and when the second electric motor is rotated in the first direction to drive the second moving piston to move towards the communication position, the first electric motor is not operated, or the first electric motor is rotated in the second direction to drive the first moving piston to move towards the off position.

19. The operating unit according to claim 18, wherein the operating unit further comprises a gas pressure monitoring device configured to detect gas pressure inside the inflatable bathtub wall, and the gas pressure monitoring device is configured to send, when detecting that the gas pressure inside the inflatable bathtub wall reaches or is greater than a predetermined gas pressure value, a signal to the control panel, so as to generate a physical operation command used to make the first electric motor rotate in the second direction so as to drive the first moving piston to move towards the off position.

* * * * *